United States Patent [19]

Pu

[11] 4,105,446

[45] Aug. 8, 1978

[54] ORGANIC PHOTOCONDUCTIVE COATING COMPOSITIONS CONTAINING TRICYANOVINYL COMPOUNDS FOR ELECTROPHOTOGRAPHY

[75] Inventor: Lyong Sun Pu, Minami-ashigara, Japan

[73] Assignee: Fuji Xerox Co., Ltd., Tokyo, Japan

[21] Appl. No.: 649,545

[22] Filed: Jan. 15, 1976

[30] Foreign Application Priority Data

Jan. 21, 1975 [JP] Japan ..... 50-008339
Jan. 21, 1975 [JP] Japan ..... 50-008340

[51] Int. Cl.[2] ..... G03G 5/04

[52] U.S. Cl. ..... 96/1.5 R; 252/501; 204/159; 204/22

[58] Field of Search ..... 96/1.5; 252/501

[56] References Cited

U.S. PATENT DOCUMENTS

| | | | |
|---|---|---|---|
| 3,421,891 | 1/1969 | Inami et al. | 96/1.5 |
| 3,721,552 | 3/1973 | Tellier et al. | 96/1.5 |
| 3,864,126 | 2/1975 | Nishide et al. | 96/1.5 |

*Primary Examiner*—John D. Welsh
*Attorney, Agent, or Firm*—Gerald J. Ferguson, Jr.; Joseph J. Baker

[57] ABSTRACT

An electrophotographic element comprising a support and an organic photoconductive layer formed on the support, the photoconductive layer consisting essentially of (a) an organic photoconductive material, (b) about 0.001 to about 1.20 moles of a nitro derivative selected from the group consisting of a nitro derivative of dibenzothiophenedioxide having the following general formula

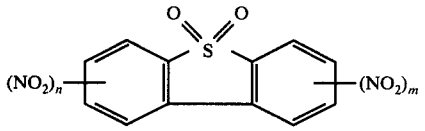

wherein $m$ and $n$ are independent integers and $1 \leqq m + n \leqq 4$, and a nitro derivative of dibenzothiophenesulfoxide having the following general formula

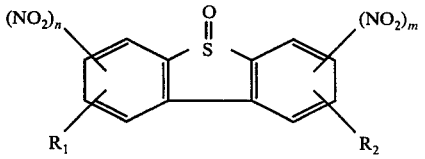

wherein $m$ and $n$ are independent integers and $1 \leqq m + n \leqq 4$, and $R_1$ and $R_2$ are independently hydrogen, an alkyl group containing from 1 to 7 carbon atoms, a phenyl group, an acetyl group, a carboxyl group, a cyano group or a halogen atom, and (c) about 0.001 to about 1 mole of a tricyanovinyl compound, substances (b) and (c) each being based on 1 mole of the organic photoconductive material or 1 mole of the starting monomer when a polymeric material is used as the organic photoconductive material.

5 Claims, No Drawings

ORGANIC PHOTOCONDUCTIVE COATING COMPOSITIONS CONTAINING TRICYANOVINYL COMPOUNDS FOR ELECTROPHOTOGRAPHY

BACKGROUND OF THE INVENTION

1. Field of the Invention

This invention relates to an electrophotographic element and in particular an electrophotographic element utilizing an organic photoconductive material having excellent photosensitivity and stable characteristic properties.

2. Discussion of the Prior Art

Various photoconductive materials have been proposed including inorganic substances such as selenium and zinc oxide, organic low-molecular weight compounds such as anthracene, perillene, pyrazoline, and imidazole, and organic polymeric compounds such as polyvinylcarbazole and polyvinylanthracene. Organic photoconductive materials are generally advantageous in that (a) they are very transparent when formed into a film and in their film-forming property, (b) they exhibit favorable plasticity, and (c) they are available at low cost. Accordingly, many attempts have been made to utilize the organic photoconductive materials in practical applications. However, organic photoconductive materials have important drawbacks in that (a) they are considerably lower in photosensitivity when compared with inorganic photoconductive materials such as selenium and zinc oxide and (b) the spectral sensitivities of organic photoconductive materials are disadvantageously biased toward the microwave range. Therefore, various efforts have been made to improve the sensitivities thereof. However, though a number of studies concerning organic photoconductive materials suitable for use in electrophotography have been made in recent years, there are few known organic photoconductive materials which have a high enough level of photosensitivity as to be utilizable in practical applications. For example, Japanese Patent Disclosure Publication No. 94337/1974 describes an organic photoconductive material which comprises a photoconductive or semiconductive organic compound and an electron acceptor composed of mononitro-, dinitro- or trinitrodibenzothiophenesulfoxide or dibenzothiophenedioxide, and which exhibits favorable properties in either negative or positive charging polarity. However, this organic photoconductive material is not considered satisfactory in practical applications due to its still low photosensitivity. Moreover, the above-mentioned patent publication described that the organic photoconductive material may further comprise (a) one or more photoconductive materials other than the first-mentioned photoconductive organic material and the mononitro-, dinitro or trinitrodibenzothiophenesulfoxide or dibenzothiophenedioxide, and/or (b) one or more photoconductive sensitizing agents. However, third or sensitizing additives which would have a substantial effect on the photosensitivity of the organic photoconductive material are not particularly mentioned in the specification of this patent publication. Further, even if there are added to the organic photoconductive material a photoconductive material other than the electron acceptor mentioned above and a sensitizer, the sensitization of the organic photoconductive material generally increases at most from several percent to several tens percent. In some cases, the sensitization may decrease by such addition. Also, it is considered difficult to enhance the sensitivity of an organic photoconductive material to a substantial extend by adding thereto a sensitizer and other photoconductive materials without impairing the important feature that the organic photoconductive material can be charged either positively or negatively.

SUMMARY OF THE INVENTION

Under these circumstances, an intensive study of photoconductive elements has been conducted using organic photoconductive materials in order to improve their photosensitivity and an organic photoconductive material or composition has been successfully obtained, which is as excellent in photosensitivity as selenium or zinc oxide. This has been achieved by adding to an organic photoconductive material of the above mentioned type a nitro derivative of dibenzothiophenesulfoxide or dibenzothiophenedioxide and a tricyanovinyl compound.

It is therefore an object of the present invention to provide an electrophotographic element including an organic light-sensitive material which overcomes the above-mentioned difficulties or problems and which is effective in practical applications.

As stated above, the above object is achieved by adding to an organic photoconductive material a nitro derivative of dibenzothiophenesulfoxide or dibenzothiophenedioxide and a tricyanovinyl compound.

Other objects and advantages of this invention will be apparent from a reading of the following specification and claims.

DETAILED DESCRIPTION OF THE PREFERRED EMBODIMENTS

An electrophotographic element comprising a support and an organic photoconductive layer formed on the support, the photoconductive layer consisting essentially of (a) an organic photoconductive material, (b) about 0.001 to about 1.20 moles of a nitro derivative selected from the group consisting of a nitro derivative of dibenzothiophenedioxide having the following general formula

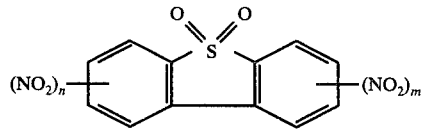

wherein $m$ and $n$ are independent integers and $1 \leqq m+n \leqq 4$, and a nitro derivative of dibenzothiophenesulfoxide having the following general formula

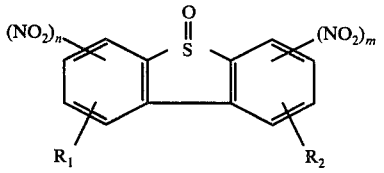

wherein $m$ and $n$ are independent integers and $1 \leqq m+n \leqq 4$, and $R_1$ and $R_2$ are independently hydrogen, an alkyl group containing from 1 to 7 carbon atoms, a phenyl group, an acetyl group, a carboxyl group,a cyano group or a halogen atom, and (c) about 0.001 to about 1 mole of a tricyanovinyl compound, substances (b) and (c) each being based on 1 mole of the organic photoconductive material or 1 mole of the starting monomer when a polymeric material is used as the organic photoconductive material.

Though various tricyanovinyl compounds may be suitably used in the present invention, tricyanovinylindole, tricyanovinylfandole, tricyanovinylpyrrole and alkyl derivatives thereof, tricyanovinyldiphenylamine and the like are preferred. Examples of the organic photoconductive materials suitable for the purpose of the present invention include polymeric organic photoconductive materials such as poly-N-vinylcarbazole, derivatives of poly-N-vinylcarbazole, polyacenaphthylene, polyvinylanthracene and the like, aromatic photoconductive materials such as anthracene, perillene, chrysene and the like, and heterocyclic organic photoconductive materials such as derivatives of pyrazoline, imidazol and the like. The nitro derivative of dibenzothiophenedioxide or dibenzothiophenesulfoxide is used in an amount of about 0.001 - 1.20 moles, preferably 0.01 - 0.5 moles, per mole of the organic photoconductive material, and the tricyanovinyl compound is used in an amount of about 0.001 - 1 mole, preferably 0.01 - 0.3 moles, per mole of the organic photoconductive material. When the amounts of the respective additives are less than 0.001 mole, the photosensitivity of the final photosensitive material is not improved. On the other hand, when the nitro derivative and the tricyanovinyl compound are added in amounts of greater than 1.20 moles and 1 mole, respectively, the charging characteristics of the final photosensitive material are unstable.

The addition of the nitro derivative of dibenzothiophenedioxide or dibenzothiophenesulfoxide and the tricyanovinyl compound to the above-mentioned photoconductive material is effected by first dissolving the photoconductive material in a solvent and then adding the two additives to the resulting solution. Alternatively, the nitro derivative and/or the tricyanovinyl compound may be first dissolved in a solvent, to which the organic photoconductive material is added for dissolution. Examples of solvents useful in the present invention include aromatic solvents such as benzene, toluene and the like, chloroform, dichloromethane, dioxane, tetrahydrofuran, and the like. These solvents may be used alone or in combination.

The photosensitivity of the photoconductive material obtained by the present invention is 1000 - 10000 times as great as that of an organic photoconductive material alone, and is several to several hundreds times as great as that of a photoconductive material which is composed of an organic photoconductive material and a nitro derivative of dibenzothiophenedioxide or dibenzothiophenesulfoxide.

In the present invention, various conductive supports may be used including a metal plate, a paper sheet, a plastic film, fibres and composite materials thereof.

It is useful to add plasticizers to the photoconductive material of the present invention in a manner as is generally done with synthetic polymers so as to improve the mechanical strength thereof. Plasticizers useful in the present invention are, for example, a polyester resin, chlorinated biphenyl, chlorinated paraffin, phospate-base plasticizers, and phthlate-base plasticizers. These are generally used in an amount of 0 to 60 wt.% based on the photoconductive material.

The photoconductive material or composition of the present invention is applied onto a support to form a film having a thickness of 3 - 20 $\mu$. The film must be satisfactorily dried to completely remove the solvent. The photoconductive film may then be subjected to corona discharge and image exposure in a solvent free-condition in the usual manner of electrophotography followed by developing by a cascade developing method or a liquid developing method. After completion of development, the image may be transferred to a paper sheet or a plastic film and fixed, or may be fixed as it is by gentle heating or by placing it in an atmosphere of the vapor of a suitable solvent.

The present invention will be particularly illustrated by way of the following examples, which are not to be limitative of the invention.

EXAMPLE 1

0.7 g of poly-N-vinylcarbazole, 0.222 g of dinitrodibenzothiophenedioxide and 32.4 mg of tricyanovinyl-N-ethylcarbazole were dissolved in 12 ml of tetrahydrofuran. The resultant solution was applied onto an aluminum plate and dried to form a film about 10 $\mu$ thick. The thus formed photoconductive plate was subjected to (a) corona discharge at 8 KV in the dark to charge it either positively or negatively and (b) light exposure by means of a tungsten lamp so that the surface illumination reached 20 lux. During the exposure, the relationship between the attenuation of the surface potential and time was recorded by a recorder and a half-decay exposure value was calculated from the period of time required to reduce the initial surface potential to half. The half-decay exposure value was 10 lux. sec when the film was positively charged, and was 25 lux. sec when the film was negatively charged.

EXAMPLE 2

0.7 g of poly-N-vinylcarbazole, 0.222 g of dinitrodibenzothiophenedioxide and 44 mg of tricyanovinylphenylamine were dissolved in 12 ml of tetrahydrofuran. The half-decay exposure value was determined in the same manner as in Example 1 and was 28 lux. sec when the film was charged positively and was 36 lux. sec when the film was charged negatively.

EXAMPLE 3

0.7 g of poly-N-vinylcarbazole, 0.222 g of dinitrodibenzothiophenedioxide and 42 mg of tricyanovinylindole were dissolved in 12 ml of tetrahydrofuran. The half-decay exposure value was determined in the same manner as in Example 1 and was 20 lux. sec when the film was charged positively.

EXAMPLE 4

0.7 g of poly-N-vinylcarbazole, 0.222 g of dinitrodibenzothiophenedioxide and 45 mg of 2-methyltricyanominylindole were dissolved in 12 ml of tetrahydrofuran. The half-decay exposure value was determined in the same manner as in Example 1 and was 21 lux. sec when the film was charged positively.

EXAMPLE 5

0.7 g of poly-N-vinylcarbazole, 0.222 g of dinitrodibenzothiophenedioxide and 42 mg of 4-tricyanovinyl-N,N-dimethylaniline were dissolved in 12 ml of tetrahydrofuran. The half-decay exposure value was determined in the same manner as in Example 1 and was 24 lux. sec when the film was charged positively.

When the above procedure was repeated using other organic photoconductive substances instead of poly-N-vinylcarbazole and mononitro-, trinitro- and tetranitrobenzothiophenedioxide, respectively, instead of dinitrodibenzothiophenedioxide, similar results were obtained.

EXAMPLE 6

0.70 g of poly-N-vinylcarbazole, 53 mg of dinitrodibenzothiophenesulfoxide and 42 mg of tricyanovinyl-N-ethylcarbazole were dissolved in 12 ml of tetrahydrofuran. The resultant solution was applied onto an aluminum plate and dried to form a film about 10 $\mu$ thick. Then, the thus formed film was charged in the dark by corona discharge at 8 KV and exposed to a light image by means of a tungsten lamp so that the surface illumination reached 20 lux. During the exposure, the relationship between the attenuation of the surface potential and time was recorded by a recorder and a half-decay exposure value was calculated from the period of time required to reduce the initial surface potential to half. The half-decay exposure value was 21 lux. sec when the film was positively charged, and was 32 lux. sec when the film was charged negatively.

EXAMPLE 7

0.70 g of poly-N-vinylcarbazole, 0.10 g of dinitrodibenzothiophenesulfoxide and 56 mg of tricyanovinyl-N-ethylcarbazole were dissolved in 12 ml of tetrahydrofuran.Then, Example 1 was repeated to determine the half-decay exposure value, which was 25 lux. sec when the film was charged positively and 32 lux. sec when the film was charged negatively.

What is claimed is:

1. An electrophotographic element comprising a support and an organic photoconductive layer formed on said support, said photoconductive layer consisting essentially of (a) an organic photoconductive material, (b) about 0.001 to about 1.20 moles of a nitro derivative selected from the group consisting of a nitro derivative of dibenzothiophenedioxide having the following general formula

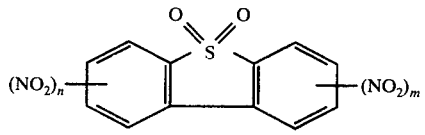

wherein $m$ and $n$ are independent integers and $1 \leqq m+n \leqq 4$, and a nitro derivative of dibenzothiophenesulfoxide having the following general formula

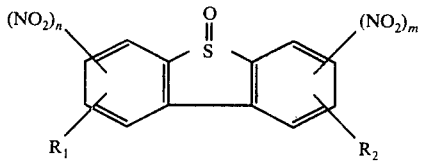

wherein $m$ and $n$ are independent integers and $1 \leqq m+n \leqq 4$, and $R_1$ and $R_2$ are independently hydrogen, an alkyl group containing from 1 to 7 carbon atoms, a phenyl group,an acetyl group, a carboxyl group, a cyano group or a halogen atom, and (c) about 0.001 to about 1 mole of a tricyanovinyl compound, substances (b) and (c) each being based on 1 mole of the organic photoconductive material or 1 mole of the starting monomer when a polymeric material is used as the organic photoconductive material.

2. The element of claim 1 where said photoconductive layer contain about 0.01 to 0.5 moles of said nitro derivative.

3. The element of claim where said photoconductive layer contains 0.01 to 0.3 moles of said tricyanovinyl compound.

4. The element of claim 1 where said photoconductive layer has a thickness of 3 - 20 $\mu$.

5. The element of claim 1 where said tricyanovinyl compound is selected from the group consisting of tricyanovinylcarbazole, tricyanovinylindole, tricyanovinylpyrrole and alkyl derivatives thereof, and tricyanovinyldiphenylamine.

* * * * *